US009513013B2

(12) United States Patent
May et al.

(10) Patent No.: US 9,513,013 B2
(45) Date of Patent: Dec. 6, 2016

(54) MANIFOLD ASSEMBLY FOR A DOMESTIC KITCHEN APPLIANCE

(75) Inventors: George May, New Bern, NC (US); Michael Penuel, Swansboro, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 918 days.

(21) Appl. No.: 13/192,675

(22) Filed: Jul. 28, 2011

(65) Prior Publication Data

US 2013/0025579 A1 Jan. 31, 2013

(51) Int. Cl.

| | |
|---|---|
| ***F24C 15/00*** | (2006.01) |
| ***F24C 7/08*** | (2006.01) |
| ***F24C 7/00*** | (2006.01) |

(52) U.S. Cl.

CPC . *F24C 7/08* (2013.01); *F24C 7/00* (2013.01); *F24C 7/082* (2013.01); *F24C 7/086* (2013.01); *Y10T 29/49826* (2015.01)

(58) Field of Classification Search

CPC ..... F24C 7/08; F24C 7/00; F24C 7/082; F24C 7/083; F24C 7/086; F24C 3/12; F24C 3/122; F24C 3/124; F24C 3/126; F24C 3/128

USPC ..... 126/19 R, 273 R, 273.5, 274, 275 R, 275 E,126/273 A

See application file for complete search history.

(56) References Cited

U.S. PATENT DOCUMENTS

| | | | | |
|---|---|---|---|---|
| 7,096,601 | B2 * | 8/2006 | Lyu et al. | 34/595 |
| 8,106,325 | B2 * | 1/2012 | Laurent et al. | 200/600 |
| 2008/0094372 | A1 * | 4/2008 | Philipp | 345/173 |
| 2009/0080153 | A1 * | 3/2009 | Richardson | H04M 1/18 361/679.56 |
| 2009/0217920 | A1 * | 9/2009 | Flesch et al. | 126/190 |
| 2010/0147823 | A1 * | 6/2010 | Anderson | F24C 7/082 219/391 |

* cited by examiner

*Primary Examiner* — Avinash Savani
*Assistant Examiner* — Vivek Shirsat
(74) *Attorney, Agent, or Firm* — Michael E. Tschupp; Andre Pallapies

(57) ABSTRACT

A manifold assembly having a plurality of controls for a domestic kitchen appliance is provided. The assembly includes a structural frame; an esthetic skin fixed to the structural frame; at least one clamp; and a control panel including the plurality of controls, the control panel being replacably removably clamped to the structural frame by the at least one clamp. The structural frame provides structural support for the skin and the control panel, and the structural frame includes control panel locating features that locate the control panel relative to the skin.

18 Claims, 5 Drawing Sheets

MANIFOLD ASSEMBLY FOR A DOMESTIC KITCHEN APPLIANCE

FIELD OF THE INVENTION

The invention is directed to a manifold assembly for a domestic kitchen appliance.

An example of an application for the invention is an assembly that includes the controls for a built-in domestic kitchen oven.

BACKGROUND OF THE INVENTION

Many domestic appliances, such as built in ovens, have a manifold assembly that includes the various controls and indicators for the operation of the oven. These assemblies often include a printed circuit board or other board having electronic and/or mechanical devices attached thereto.

Some manifold assemblies include a glass panel that displays indicator lights and is touch sensitive or transmits a touch input through to a control panel that includes the various controls. The assembly of a manifold assembly, especially one having a glass panel, can be a time consuming and detailed process. Also, some assembly methods result in a manifold assembly that is difficult, if not impossible, to disassemble. This can lead to high costs associated with repair or replacement of a damaged or defective piece. For example, the glass panel of some manifold assemblies is fixed permanently to a frame of body of the manifold assembly with a tape or other permanent bonding agent. This is often done using expensive precision equipment prior to the manifold assembly being received on the assembly plant floor.

SUMMARY

The invention recognizes that it is desirable to provide a manifold assembly that is relatively quick and easy to assemble on an assembly plant floor, is esthetically pleasing, and allows for disassembly and reassembly to replace particular parts. The invention also recognizes that it is desirable to provide a manifold assembly that includes a structural frame to which an esthetic skin, a control panel, and (in some cases) a glass panel are attached.

Particular embodiments of the invention are directed to a manifold assembly having a plurality of controls for a domestic kitchen appliance. The assembly includes a structural frame; an esthetic skin fixed to the structural frame; at least one clamp; and a control panel including the plurality of controls, the control panel being replacably removably clamped to the structural frame by the at least one clamp. The structural frame provides structural support for the skin and the control panel, and the structural frame includes control panel locating features that locate the control panel relative to the skin.

Other embodiments of the invention are directed to a domestic kitchen appliance having a body; an operation space; a door attached to the body and enclosing the operational space; and a manifold assembly having a plurality of controls for the domestic kitchen appliance. The assembly includes a structural frame; an esthetic skin fixed to the structural frame; at least one clamp; and a control panel including the plurality of controls, the control panel being replacably removably clamped to the structural frame by the at least one clamp. The structural frame provides structural support for the skin and the control panel, and the structural frame includes control panel locating features that locate the control panel relative to the skin.

Other embodiments of the invention are directed to a method of assembling a manifold assembly having a plurality of controls for a domestic kitchen appliance. The method includes providing a structural frame; fixing an esthetic skin to the structural frame; and replacably removably clamping a control panel including the plurality of controls to the structural frame with at least one clamp. The skin and the control panel are structurally supported by the structural frame, and the control panel is located relative to the skin by control panel locating features of the structural frame.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

Figures 1, 2:
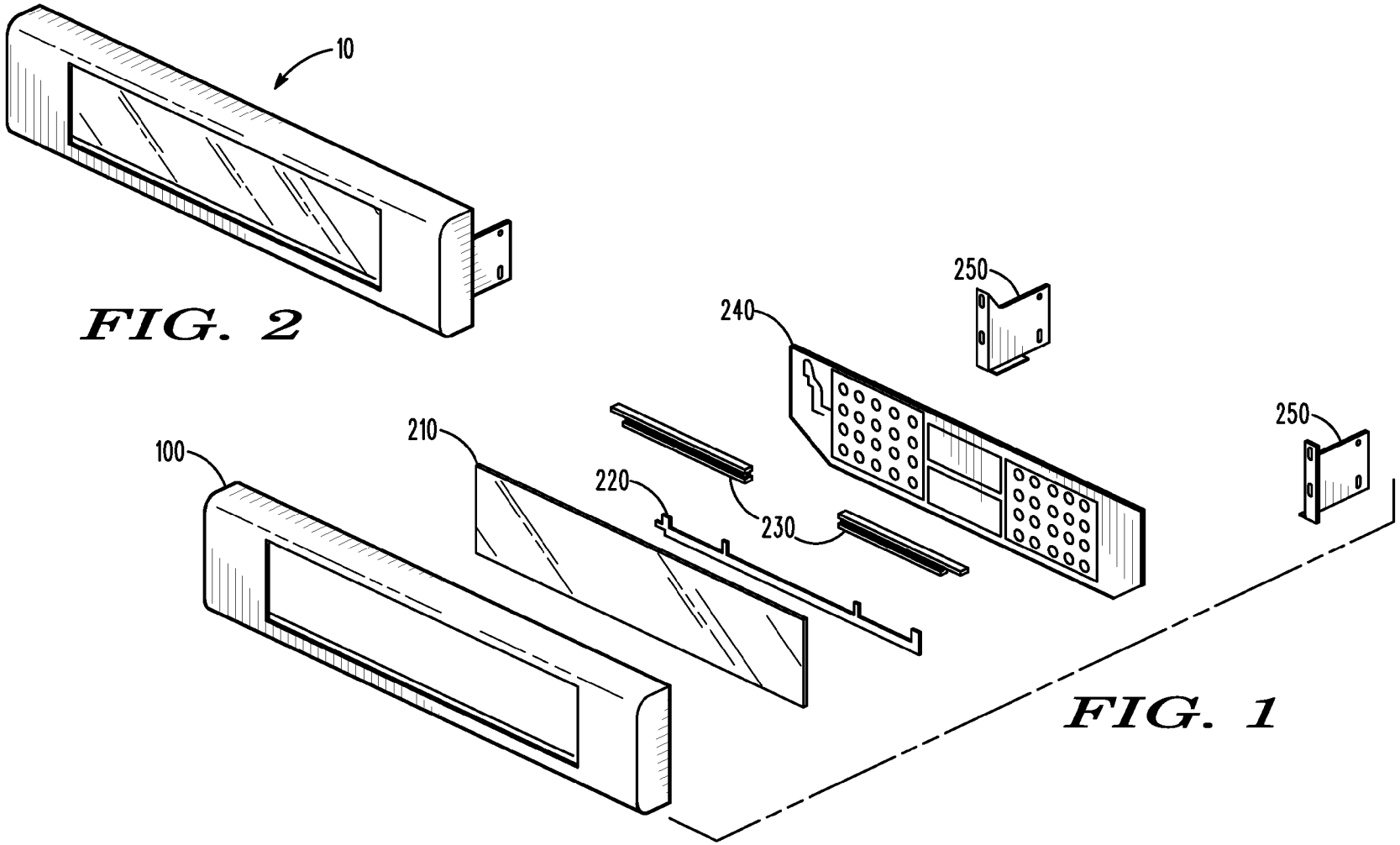
FIG. 1 is a perspective exploded view of a manifold assembly in accordance with an exemplary embodiment of the invention.
FIG. 2 is a perspective view of the assembly of FIG. 1 in an assembled state.

FIG. 1 shows an example of a manifold assembly 10 for a domestic appliance. In this example the domestic appliance is a built-in oven. Manifold assembly 10 includes a skin/frame assembly 100 into which a glass panel 210 and a control panel 240 are clamped by, in this example, bar clamps 220, 230. Brackets 250 are attached to skin/frame assembly 100 to facilitate the mounting of manifold assembly 10 to the domestic appliance. Although bar clamps are used in this example, other reusable clamping methods can be used.

FIG. 2 is a front perspective view of manifold assembly 10 in an assembled state. Although not shown in FIG. 2, a plurality of controls and indicators of control panel 240 are visible through glass panel 210. These controls and indicators can be for controlling various functions and indicating various conditions of the appliance, such as, for example, temperature, cooking time, etc.

Other embodiments have knobs and/or buttons that transmit user input to control panel 240 in addition to, or in lieu of, a glass panel. These knobs and/or buttons can protrude through openings or holes in skin/frame assembly 100.

Figure 3:
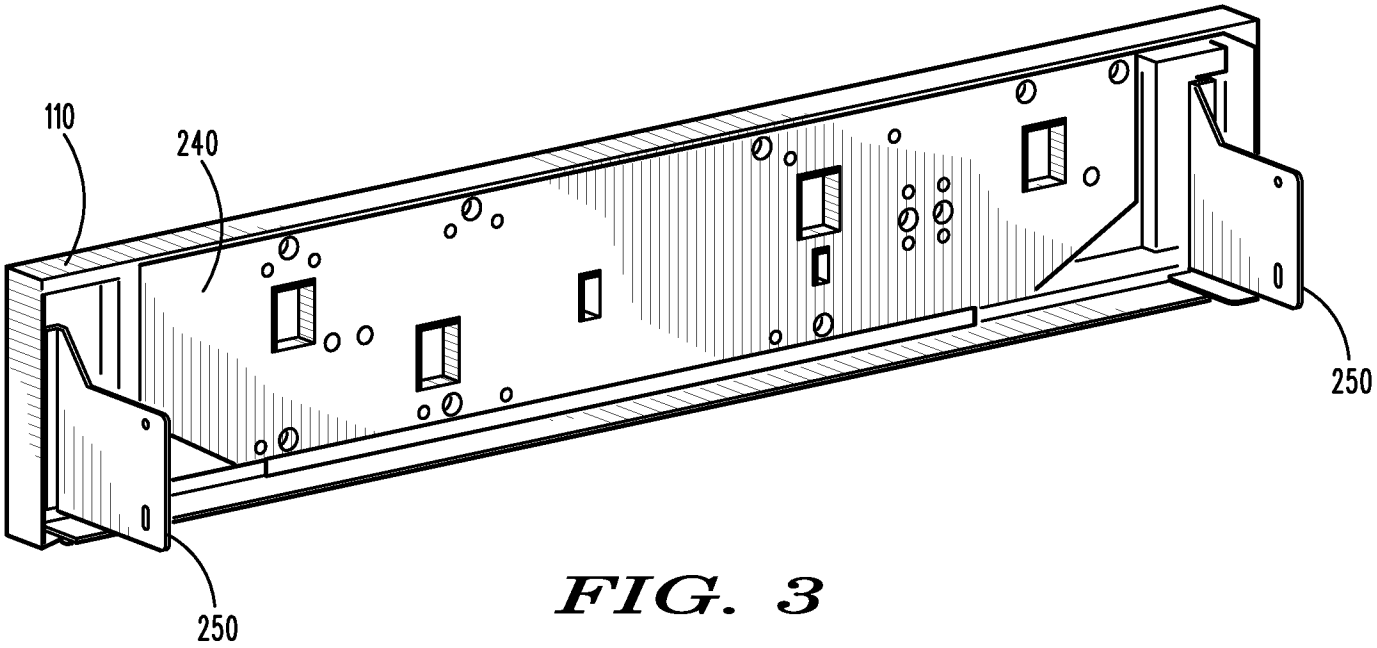
FIG. 3 is a perspective view from the rear of the assembly of FIG. 1.

FIG. 3 is a rear perspective view of manifold 10 in an assembled state. In this example, control panel 240 can be seen clamped into skin/frame assembly 100 by bar clamps 220, 230.

Figure 5:
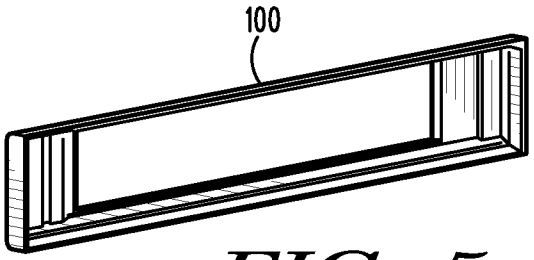
FIG. 5 is a perspective view of a portion of the assembly of FIG. 1 from the rear.
Figure 4:
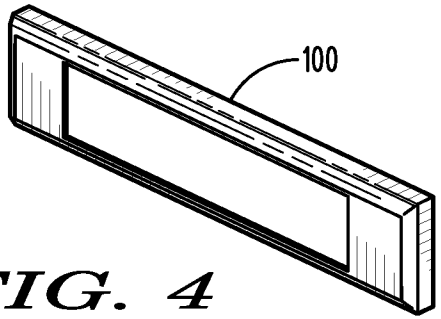
FIG. 4 is a perspective view of a portion of the assembly of FIG. 1 from the front.
Figure 6:
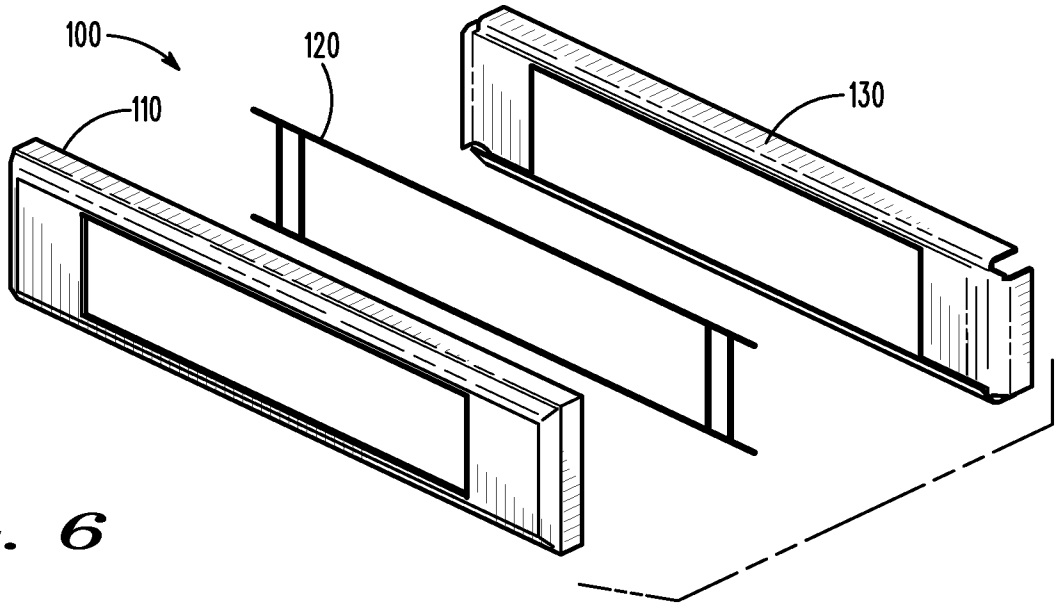
FIG. 6 is a perspective exploded view of a portion of the assembly of FIG. 1.

Skin/frame assembly 100 is shown in FIGS. 4-6. FIGS. 4 and 5 show skin/frame assembly 100 from the front and the rear, respectively. FIG. 6 is an exploded view of the three parts that make up skin/frame assembly 100 in this example. A structural frame 130 is, in this example, permanently fixed to an esthetic skin 110 by a tape or other bonding agent 120. Brackets 250 (shown in FIGS. 1-3) are, in this example, attached to structural frame 130.

Figure 7:
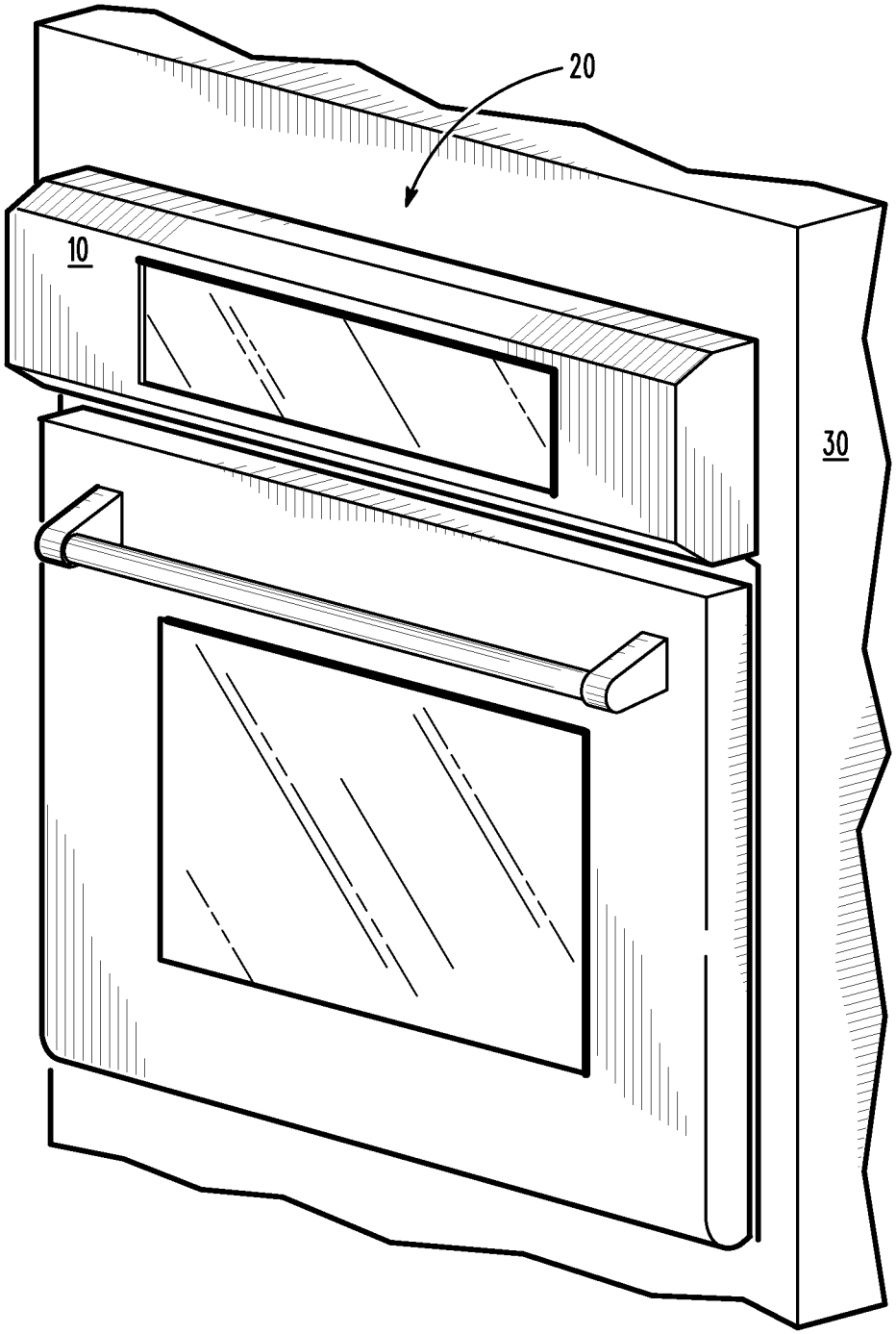
FIG. 7 shows a domestic appliance in accordance with an exemplary embodiment of the invention.

FIG. 7 shows an example of a domestic kitchen appliance 20 to which manifold assembly 10 can be attached. In this example, domestic kitchen appliance 20 is a wall oven that is built in to a cabinet 30. Although the above example is directed to a built-in conventional oven, the invention can also be applied to microwave ovens, dishwashers, or other domestic kitchen appliances.

Figure 8:
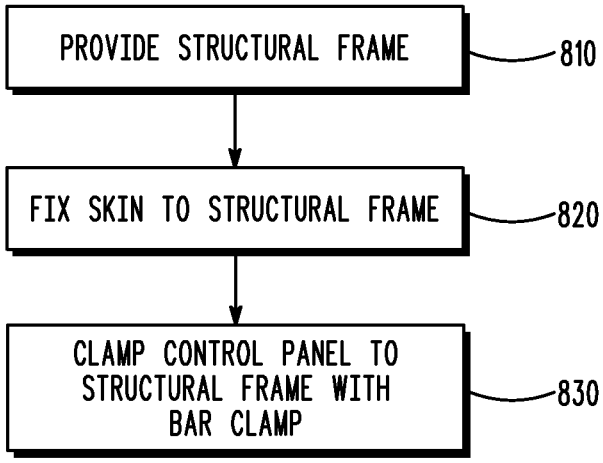
FIG. 8 shows a method in accordance with an exemplary embodiment of the invention.

FIG. 8 shows an example of a method in accordance with embodiments of the invention. In 810 structural frame 130 is provided. In 820 esthetic skin 110 is fixed to structural frame 130 with a permanent tape of other permanent bonding agent to create skin/frame assembly 100. In 830 control panel 240 is clamped to structural frame 130 with bar clamps 220, 230. In some embodiments, glass panel 210 is clamped to structural frame 130 between control panel 240 and structural frame 130.

By using a mechanical attachment method (in this case clamping) to attach control panel 240 and glass panel 210 to structural frame 130, instead of a permanent taping method, two benefits are realized. First, no taping or other bonding/gluing is needed on the factory floor during the assembly of manifold assembly 10. Second, the non-permanent nature of the mechanical attachment method permits replacement of any one of skin/frame assembly 100, control panel 240 or glass panel 210 without requiring the replacement of the others. This saves significant cost when only one of the pieces is damaged or defective. For example, in a design in which the glass panel is permanently bonded to the skin, a scratched or broken glass panel would result in having to replace the skin. Because the skin is often an expensive piece of material, such as stainless steel, this can be a wasteful result.

Various parts, including esthetic skin 110, are shown by way of example in the drawings with varying shapes. These varying shapes are meant to represent only a few of the different shapes the various parts can take.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the invention.

What is claimed is:

1. A manifold assembly having a plurality of user operable controls for a domestic kitchen appliance, the assembly comprising:

a structural frame having an opening;

an esthetic skin fixed to the structural frame, the esthetic skin having a front face and four transverse faces that extend at an angle from the front face, a cavity being formed by the front face and the transverse faces, each of the transverse faces having an edge, the edges of the transverse faces being configured to contact a front surface of the domestic kitchen appliance or a front surface of a cabinet in which the domestic kitchen appliance is installed;

a first bar-shaped clamp;

a second bar-shaped clamp;

a control panel including the plurality of user operable controls positioned on the control panel and in the entire opening of the structural frame, the control panel being replacably removably positioned inside the cavity and clamped to the structural frame by the first bar-shaped clamp and the second bar-shaped clamp, the plurality of user operable controls being any and all user operable controls that are positioned inside the cavity; and a glass panel positioned between the structural frame and the control panel and replacably removably clamped in position in the cavity with the control panel by the first bar-shaped clamp and the second bar-shaped clamp, wherein the structural frame provides structural support for the skin and the control panel, the structural frame includes control panel locating features that locate the control panel relative to the skin, the first bar-shaped clamp is positioned along and contacts an upper longitudinal edge of the control panel such that a linear surface of the first bar-shaped clamp contacts a linear surface of the upper longitudinal edge of the control panel, the linear surface of the first bar-shaped clamp being parallel to the linear surface of the upper longitudinal edge of the control panel, the second bar-shaped clamp is positioned along and contacts a lower longitudinal edge of the control panel such that a linear surface of the second bar-shaped clamp contacts a linear surface of the lower longitudinal edge of the control panel, the linear surface of the second bar-shaped clamp being parallel to the linear surface of the lower longitudinal edge of the control panel, and the structural frame, the first bar-shaped clamp, the second bar-shaped clamp, and the control panel are positioned entirely within the cavity when the manifold assembly is in an assembled state.

2. The assembly of claim 1, wherein the glass panel transmits user touches to the control panel.

3. The assembly of claim 2, wherein the glass panel is removable from the assembly separately from the control panel such that the glass panel is configured to be removed from the assembly and replaced in the assembly without damaging any part of the assembly.

4. The assembly of claim 3, wherein the structural frame includes glass panel locating features that locate the glass panel relative to the skin.

5. The assembly of claim 4, wherein the structural frame is permanently bonded to the skin.

6. The assembly of claim 5, wherein the domestic kitchen appliance is a built-in domestic kitchen appliance that is configured to be inserted into a cabinet, and the skin is configured to contact a front surface of the cabinet.

7. A domestic kitchen appliance, comprising:

a body;

an operation space;

a door attached to the body and enclosing the operational space; and a manifold assembly having a plurality of user operable controls for the domestic kitchen appliance, the assembly including a structural frame having an opening, an esthetic skin fixed to the structural frame, the esthetic skin having a front face and four transverse faces that extend at an angle from the front face, a cavity being formed by the front face and the transverse faces, each of the transverse faces having an edge, the edges of the transverse faces being configured to contact a front surface of the domestic kitchen appliance or a front surface of a cabinet in which the domestic kitchen appliance is installed, a first bar-shaped clamp, a second bar-shaped clamp, a control panel including the plurality of user operable controls positioned on the control panel and in the entire opening of the structural frame, the control panel being replacably removably positioned inside the cavity and clamped to the structural frame by the first bar-shaped clamp and the second bar-shaped clamp, the plurality of user operable controls being any and all user operable controls that are positioned inside the cavity, and a glass panel positioned between the structural frame and the control panel and replacably removably clamped in position in the cavity with the control panel by the first bar-shaped clamp and the second bar-shaped clamp, wherein the structural frame provides structural support for the skin and the control panel, the structural frame includes control panel locating features that locate the control panel relative to the skin, the first bar-shaped clamp is positioned along and contacts an upper longitudinal edge of the control panel such that a linear surface of the first bar-shaped clamp contacts a linear surface of the upper longitudinal edge of the control panel, the linear surface of the first bar-shaped clamp being parallel to the linear surface of the upper longitudinal edge of the control panel, the second bar-shaped clamp is positioned along and contacts a lower longitudinal edge of the control panel such that a linear surface of the second bar-shaped clamp contacts a linear surface of the lower longitudinal edge of the control panel, the linear surface of the second bar-shaped clamp being parallel to the linear surface of the lower longitudinal edge of the control panel, and the structural frame, the first bar-shaped clamp, the second bar-shaped clamp, and the control panel are positioned entirely within the cavity when the manifold assembly is in an assembled state.

8. The appliance of claim 7, wherein the glass panel transmits user touches to the control panel.

9. The appliance of claim 8, wherein the glass panel is removable from the assembly separately from the control panel such that the glass panel is configured to be removed from the assembly and replaced in the assembly without damaging any part of the assembly.

10. The appliance of claim 9, wherein the structural frame includes glass panel locating features that locate the glass panel relative to the skin.

11. The appliance of claim 10, wherein the structural frame is permanently bonded to the skin.

12. The appliance of claim 11, wherein the domestic kitchen appliance is a built-in domestic kitchen appliance that is configured to be inserted into a cabinet, and the skin is configured to contact a front surface of the cabinet.

13. A method of assembling a manifold assembly having a plurality of user operable controls for a domestic kitchen appliance, the method comprising:

providing a structural frame having an opening;

fixing an esthetic skin to the structural frame, the esthetic skin having a front face and four transverse faces that extend at an angle from the front face, a cavity being formed by the front face and the transverse faces, each of the transverse faces having an edge, the edges of the transverse faces being configured to contact a front surface of the domestic kitchen appliance or a front surface of a cabinet in which the domestic kitchen appliance is installed;

replacably removably clamping a control panel including the plurality of user operable controls positioned on the control panel and in the entire opening, inside the cavity and to the structural frame with a first bar-shaped clamp and a second bar-shaped clamp, the plurality of user operable controls being any and all user operable controls that are positioned inside the cavity; and positioning a glass panel between the structural frame and the control panel and replacably removably clamping the control panel and the glass panel in position in the cavity with the first bar-shaped clamp and the second bar-shaped clamp, wherein the skin and the control panel are structurally supported by the structural frame, the control panel is located relative to the skin by control panel locating features of the structural frame, the first bar-shaped clamp is positioned along and contacts an upper longitudinal edge of the control panel such that a linear surface of the first bar-shaped clamp contacts a linear surface of the upper longitudinal edge of the control panel, the linear surface of the first bar-shaped clamp being parallel to the linear surface of the upper longitudinal edge of the control panel, the second bar-shaped clamp is positioned along and contacts a lower longitudinal edge of the control panel such that a linear surface of the second bar-shaped clamp contacts a linear surface of the lower longitudinal edge of the control panel, the linear surface of the second bar-shaped clamp being parallel to the linear surface of the lower longitudinal edge of the control panel, and the structural frame, the first bar-shaped clamp, the second bar-shaped clamp, and the control panel are positioned entirely within the cavity when the manifold assembly is in an assembled state.

14. The method of claim 13, wherein the glass panel transmits user touches to the control panel.

15. The method of claim 14, wherein the glass panel is positioned such that it is removable from the assembly separately from the control panel without damaging any part of the assembly.

16. The method of claim 15, wherein the glass panel is located relative to the skin by glass panel locating features of the structural frame.

17. The method of claim 16, further comprising permanently bonding the structural frame to the skin.

18. The method of claim 17, wherein the domestic kitchen appliance is a built-in domestic kitchen appliance that is configured to be inserted into a cabinet, the method further comprising configuring the skin to contact a front surface of the cabinet.

* * * * *